US005638614A

United States Patent [19]

Hardy

[11] Patent Number: 5,638,614

[45] Date of Patent: Jun. 17, 1997

[54] SHOE PROTECTOR AND FLOOR COVERING AID

[76] Inventor: Chris Hardy, 24201 Angela St., Lake Forest, Calif. 92630

[21] Appl. No.: 574,036

[22] Filed: Dec. 18, 1995

[51] Int. Cl.[6] ..... A43B 3/16

[52] U.S. Cl. ..... 36/113; 36/72 R; 36/7.1 R; 36/7.3

[58] Field of Search ..... 36/113, 72 R, 36/7.1 R, 7.1 A, 7.3, 7.5, 7.6

[56] References Cited

U.S. PATENT DOCUMENTS

| | | | |
|---|---|---|---|
| 1,030,892 | 7/1912 | Kennedy | 36/72 R |
| 1,207,024 | 4/1916 | Griffin | 36/7.5 |
| 1,954,569 | 4/1934 | League | 36/72 R X |
| 3,175,292 | 3/1965 | MacQuaid et al. | 36/72 R |
| 3,177,596 | 4/1965 | Siger | 36/7.1 R |
| 3,334,427 | 8/1967 | Edwards et al. | 36/72 R |
| 3,421,234 | 1/1969 | Sargent | 36/72 |
| 4,005,534 | 2/1977 | Crist et al. | 36/72 R |
| 4,069,599 | 1/1978 | Alegria | 36/7.2 |
| 4,638,574 | 1/1987 | Roda | 36/7.2 |
| 4,662,082 | 5/1987 | Shabazz | 36/72 B |
| 5,315,767 | 5/1994 | Bradbury | 36/7.1 R |

FOREIGN PATENT DOCUMENTS

| | | | |
|---|---|---|---|
| 33983 | 4/1929 | France | 36/7.1 R |
| 25382 | 3/1902 | Switzerland | 36/113 |

*Primary Examiner*—Ted Kavanaugh
*Attorney, Agent, or Firm*—Dennis W. Beech

[57] ABSTRACT

The shoe protector and floor aid is a slip on device having a sole with a toe guard and a heel guard. The toe guard has a tongue attached by a flexible joint. The tongue is then attached by straps to a right side guard and a left side guard which guards are attached to wings on the sole. The shoe protector is slipped over the users regular shoe and attached by retainer straps and buckles. The shoe protector is made of non-marring material to prevent damage to surfaces when used in construction and installing flooring. The material protects the wearers normal shoes when working and when kicking carpeting to position it for installation.

5 Claims, 3 Drawing Sheets

SHOE PROTECTOR AND FLOOR COVERING AID

BACKGROUND OF THE INVENTION

1. Field of the Invention

This invention relates to devices placed on shoes to protect the shoes and working surface when working with flooring such as, carpeting, tile, vinyl, marble, or other construction materials, such as, stone, bricks, etc. The new device is also an aid for use in installing carpeting.

2. Description of Related Art

There are currently in use various devices for protecting shoes. The most common include the slip on rubber or plastic rain protector shoes which are designed to slip over the normal walking shoe for protection against water damage. Such slip on shoes come in many shapes and sizes to fit a variety of styles of shoes worn by persons.

More specific devices have been developed to protect the heels and toes of shoes as well as for protection of the soles. The devices usually fit over the heel or toe and protect the heel or toe and that portion of the sole at the heel or toe ends. In the case of sole protectors, the device may stretch to fit around the lower portion of a shoe and retain a sole under the shoe. Such devices may also have attachment means associated with the shoes to be protected.

Currently known shoe protection devices include that disclosed in U.S. Pat. No. 4,638,574. The removable shoe protector has a toe protector and half sole which fit over the toe end of the shoe. The shoe protector is retained on the shoe by a strap around the rear of the shoe. Such a shoe protector is intended to protect the wearers toe from injury.

The present invention provides a slip on shoe protector held by a retainer strap. The shoe protector has a latex rubber full sole with an attached toe guard and heal guard. The sole stretches to fit various shoe sizes. There are side guards with straps which are attached to a shoe protector tongue which is attached to the toe guard. A retainer strap is attached to the heel guard and attached to buckles on the tongue. The retainer strap may also be attached to the side guards.

The toe guard protects the shoe and prevents damage to flooring when dragging the toe on a floor. The side guards provide the same function. In addition when used in connection with installing carpeting the side guards and heel guard protect the shoe and aid in kicking carpeting to properly position it.

SUMMARY OF THE INVENTION

A primary objective of the present invention is to provide a slip on shoe protector. Another object is to provide a shoe protector which does not damage flooring or other materials when used in construction and installation work. A further object is to provide a shoe protector which aids in installing carpeting.

In accordance with the description presented herein, other objectives of this invention will become apparent when the description and drawings are reviewed.

DESCRIPTION OF THE PREFERRED EMBODIMENT

The shoe protector consists of a sole with a toe guard and a heel guard attached. The toe guard has a tongue attached which tongue is attached to a right and left side guard by straps. When the shoe protector is slipped over the persons shoe, the shoe protector is fastened by retainer straps.

Figure 1:
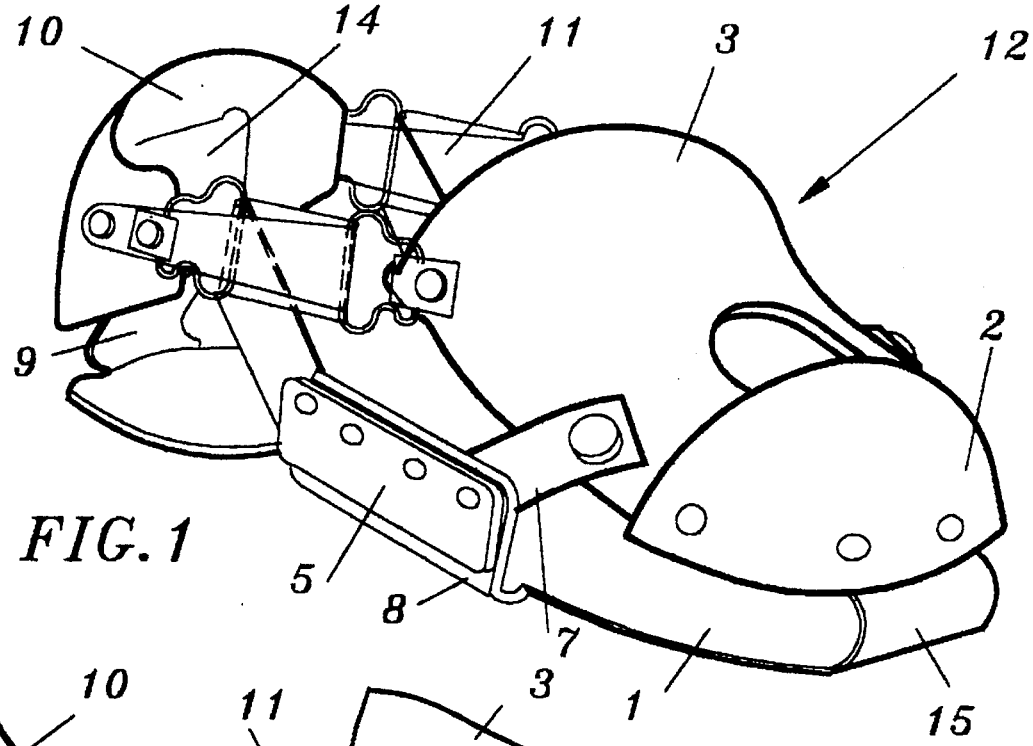
FIG. 1 illustrates a top perspective view of the shoe protector.
Figure 2:
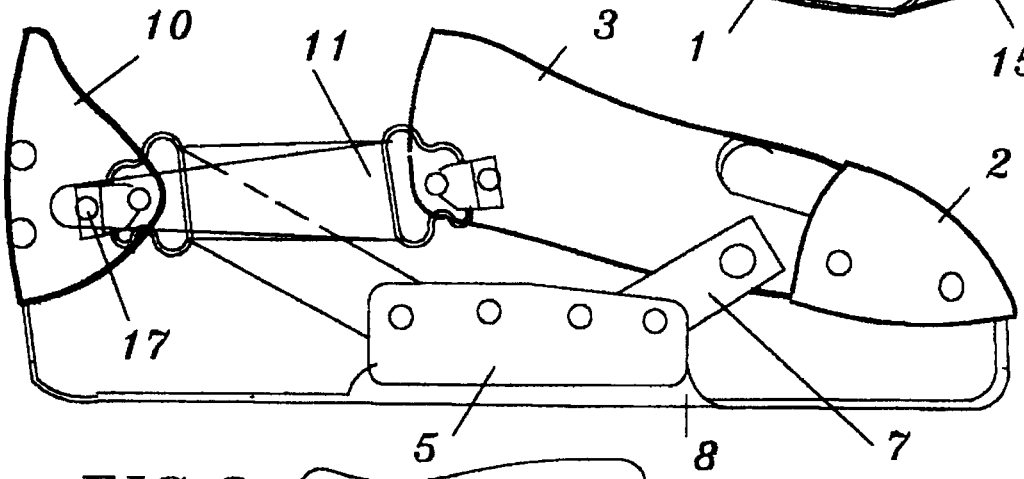
FIG. 2 illustrates a side view of the shoe protector.
Figure 3:
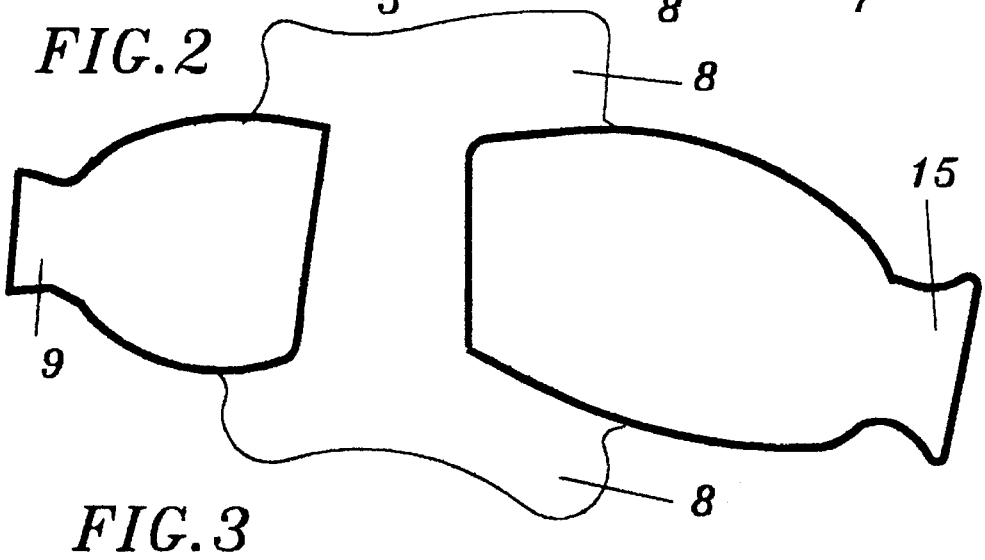
FIG. 3 illustrates the sole of the shoe protector.
Figure 4:
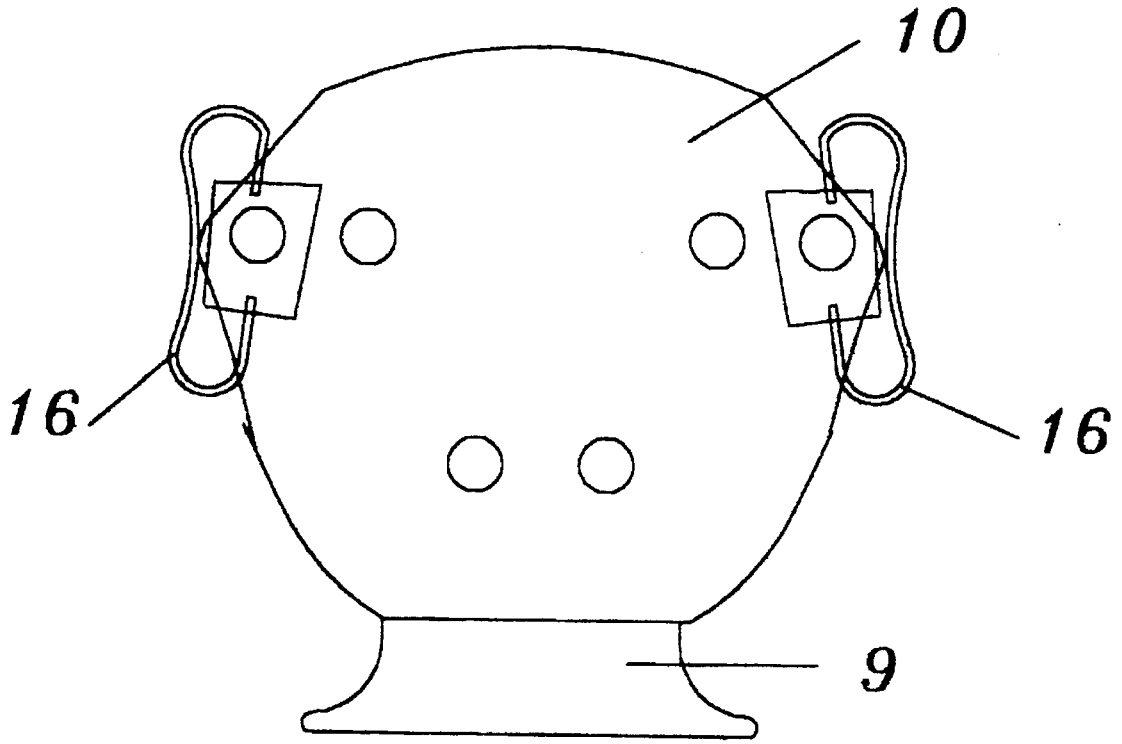
FIG. 4 illustrates a back view of the shoe protector.
Figure 5:
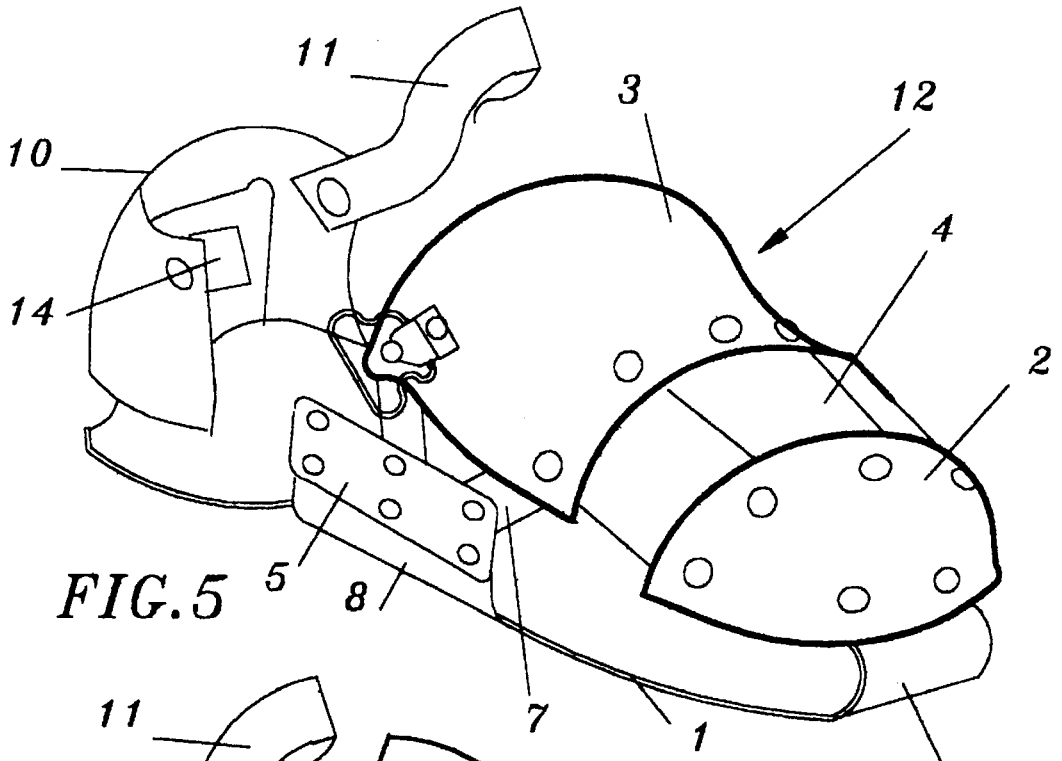
FIG. 5 illustrates a top perspective view of an alternate version of the shoe protector.
Figure 6:
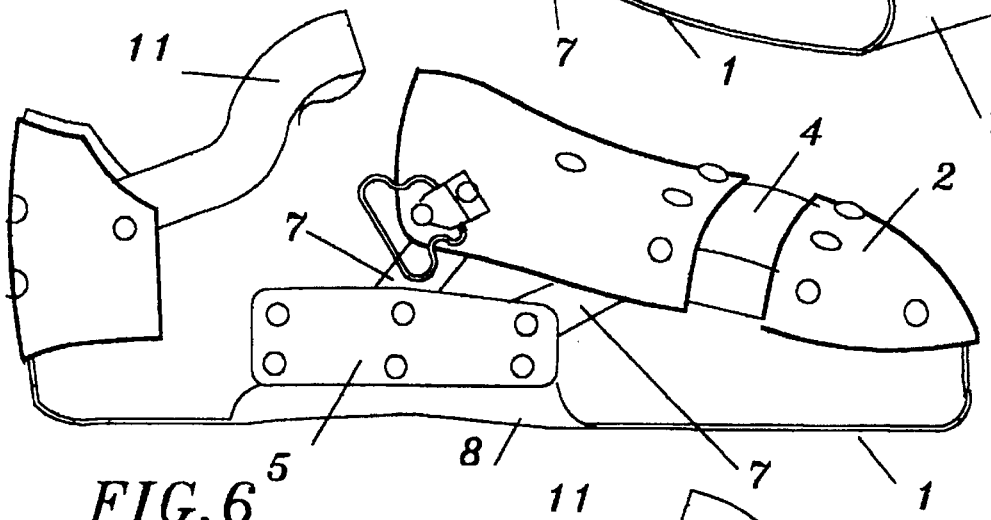
FIG. 6 illustrates a side view of the alternate version.
Figure 7:
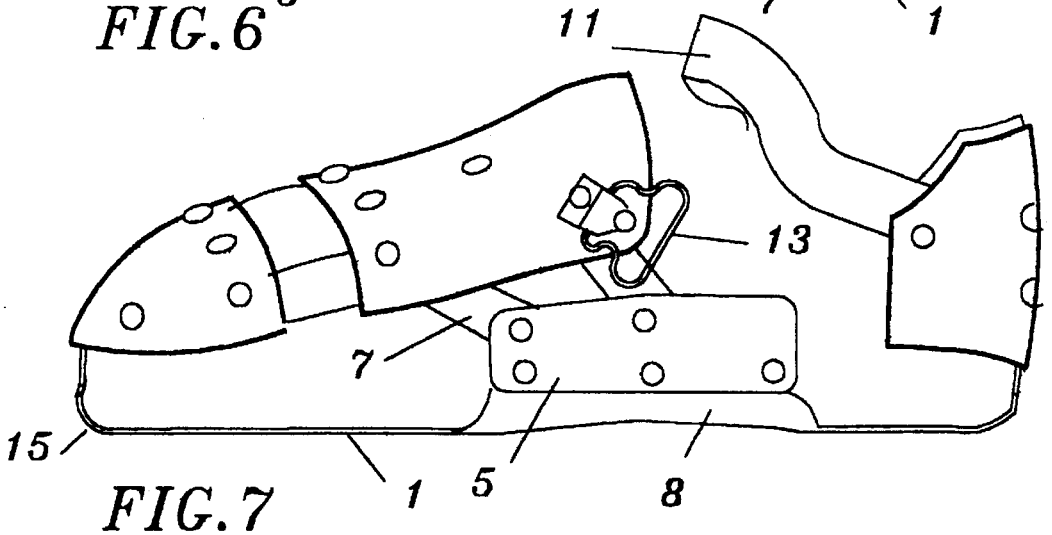
FIG. 7 illustrates an opposite side view of the alternate version.

Referring to FIGS. 1 through 4, a sole (1) of latex rubber has a toe guard (2) attached at a sole toe (15) by rivets or similar means. The toe guard (2) has a tongue (3) attached which may be of leather or other suitable material. The toe guard (2) is made of a non-marring plastic or other suitable material to prevent damage to flooring surfaces.

The tongue (3) is attached to a right side guard (5) and left side guard (6) by side straps (7). The side guards (5,6) are attached to the sole (1) at wings (8). This configuration provides an assembly into which the user slips the toe of their shoe.

The sole heel (9) has a heel guard (10) attached which heel guard (10) has two heel buckles (16) and two snaps (17) attached. To hold the shoe protector (12) on the users shoe, the retainer straps (11) are attached to the side guards (5,6) then passed through heel buckles (16) then to buckles (13) and finally snapped at snaps (17). Snaps or other suitable attachment means are used to attach the retainer straps (11). The heel guard (10) is also made of a suitable non-marring material.

An alternate version of the shoe protector (12) has a tongue (3) which is attached to the toe guard (2) by a flexible joint (4). The flexible joint is made of leather or other suitable material while the tongue (3) is of plastic or other rigid non-marring material. In addition, alternate retainer straps (11) are illustrated to be attached to the heel guard (10) to loop through the buckles (13). An additional side strap (7) is attached between the side guards (5,6) and the tongue (3).

The attachment of the shoe protector (12) elements may be by recessed rivets as illustrated in the drawings or other suitable attachment means which do not present a protrusion which would mar a floor surface or other surface if the shoe protector (12) is drug on such surface.

The latex rubber sole (1) is designed to stretch such that shoe protector (12) sizes of small, medium, large, etc. may be manufactured. In addition removable foam inserts (14) may be used in the heel guard (10), toe guard (2) and tongue (3) to change the size of the shoe protector (12). Such inserts (14) may be retained in place by hook and loop means.

The tongue (3) may be shaped such that its length allows the unlacing of shoes such as high top tennis shoes such that the wearer may remove their shoes without first removing the shoe protector (12).

I claim:

1. A device for protecting shoes comprising:

a sole of latex rubber having a sole toe, a sole heel and a pair of wings;

a toe guard made of non-marring material attached to the sole toe;

a tongue attached to the toe guard;

the tongue attached to a right side guard and a left side guard which are made of non-marring material;

a heel guard made of non-marring material attached to the sole heel; and a pair of retainer straps attached to the right side guard and the left side guard and having a cooperative attachment means for a pair of buckles which are attached to the tongue and a pair of heel buckles attached to the heel guard.

2. The device as in claim 1 wherein the non-marring material is a plastic and the attachment of the toe guard, the tongue, the right side guard, the left side guard and the heel guard is by recessed rivets.

3. The device as in claim 1 wherein the tongue is attached to the right side guard and the left side guard by side straps.

4. The device as in claim 1 wherein the toe guard, the tongue and the heel have provision for attachment of an insert.

5. The device as in claim 4 wherein the attachment for the insert is by hook and loop means.

* * * * *